United States Patent [19]

Kesten

[11] 4,455,903

[45] Jun. 26, 1984

[54] ADJUSTABLE ANVIL ROLL

[75] Inventor: Martin Kesten, West Hartford, Conn.

[73] Assignee: Preston Engravers, Inc., Windsor, Conn.

[21] Appl. No.: 441,637

[22] Filed: Nov. 15, 1982

[51] Int. Cl.[3] ..... B26D 7/20

[52] U.S. Cl. ..... 83/346; 83/659

[58] Field of Search ..... 83/346, 659, 658

[56] References Cited

U.S. PATENT DOCUMENTS

| | | | |
|---|---|---|---|
| 2,870,582 | 1/1959 | Raske . | |
| 2,971,765 | 2/1961 | Atherholt . | |
| 3,048,345 | 8/1962 | Willard . | |
| 3,173,325 | 3/1965 | Warren et al. . | |
| 3,221,449 | 12/1965 | Lewis et al. . | |
| 3,223,341 | 12/1965 | Gadde . | |
| 3,225,418 | 12/1965 | Fara . | |
| 3,362,113 | 1/1968 | Feather . | |
| 3,587,374 | 6/1971 | Stewart et al. . | |
| 3,742,714 | 7/1973 | Thomas . | |
| 3,782,234 | 1/1974 | Rodach | 83/665 |
| 3,917,422 | 11/1975 | Betzler . | |
| 4,045,196 | 8/1977 | Schaefer | 83/659 |
| 4,069,749 | 1/1978 | Olsen et al. | 83/665 X |
| 4,130,042 | 12/1978 | Reed | 83/344 X |
| 4,226,150 | 10/1980 | Reed | 83/346 |

*Primary Examiner*—Donald R. Schran

[57] ABSTRACT

An anvil roll, for use with a rotary cutting or creasing die, has an expandable shell by which the clearance therebetween can readily be varied. The position of the shell surface is controlled by hydraulic pressure, the magnitude of which is determined by the location of an adjustable piston within a suitable cylindrical section of the internal hydraulic system.

7 Claims, 5 Drawing Figures

ADJUSTABLE ANVIL ROLL

BACKGROUND OF THE INVENTION

Die rolls used for label converting, and similar operations, must generally be adapted to the particular type of web material involved. More specifically, the clearance between the cutting edge of the die and the underlying base surface, which is determined by the relationship of the cutting edge and the anvil roll surface to their respective bearers, must be correlated to web thickness, for satisfactory results. If the cutting edge is too high, it will penetrate the liner of the laminate excessively, breaking the release coat and causing the adhesive to bleed and/or the liner to fracture; this will ultimately give rise to problems in end use of the label, particularly for automatic applications. If, on the other hand, the liner is thinner than anticipated, the depth of penetration will be inadequate for satisfactory adhesive separation, causing stripping problems.

One approach to this sort of difficulty has been the provision of a series of special stepped anvil rolls, which have cylindrical surfaces that are at different heights relative to the end bearers, permitting selection to either raise or lower the web in relation to the cutting edge, as required. Not only can changes thereby be made in the weight of the liner material used with a particular die, but a temporary solution to problems attendant to wear of the cutting edge is also provided. Maintaining a selection of anvil rolls may not, however, be entirely satisfactory in all instances, not only because of the expense entailed but also because of the manpower demands and down-time involved in identifying the roll that will give the best results in any given situation. Thus, there is a demand for an alternative solution to the need for means by which the clearance between the anvil roll surface and the cutting edge can be changed to accommodate the range of conditions encountered in die cutting operations.

In a related but slightly different application, web stock can be creased, folded, hinged and scored using rotary dies. Similar problems are encountered in controlling the depth of penetration of the die element, and in accommodating webs of different thicknesses; as used herein, therefore, reference to "cutting" should be broadly construed to include such related operations.

In U.S. Pat. Nos. 4,130,042 and 4,226,150, Reed discloses means by which the eccentricity of end bearers of an anvil roll can be varied to change the clearance between rollers. The mechanisms proposed are, however, relatively complex; moreover, they require that both of the end bearers be adjusted, thus introducing the possibility of inaccuracy due to misalignment and clearance variation across the width of the web.

Accordingly, it is a primary object of the present invention to provide a novel anvil roll in which the height of the cylindrical body portion, which provides the base surface against which the die element operates, can be varied in relation to the circumference of the end bearers.

It is a more specific object of the invention to provide such a variable diameter anvil roll in which the relationship between the bearers and the cutting base surfaces, and hence of the cutting edge relative thereto, can be adjusted without dismounting the roll from the press.

Another object of the invention is to provide such a novel roll having a self-contained hydraulic system, which roll is of relative simple and inexpensive construction, and which requires virtually no added effort for installation or use.

Still another object of the invention is to provide a novel rotary die cutting assembly for mounting in a press, which includes a variable diameter anvil roll having the features and advantages described.

SUMMARY OF THE INVENTION

It has now been found that certain of the foregoing and related objects of the invention can be readily attained in a variable diameter anvil roll for cooperation with an adjacently mounted rotary die. The anvil roll comprises a core member having a cylindrical body portion and shaft portions extending axially from the opposite ends thereof, for journalling in the press, annular bearers adjacent the opposite ends of the body portion, and a resiliently deformable tubular sleeve member affixed upon the body portion between the bearers. The sleeve member has an inside diameter that is slightly larger than the outside diameter of the body portion, and is sealed thereto adjacent its opposite ends, to define a shallow cylindrical space therebetween. A passageway extends through each of the shaft portions of the core member into communication with the cylindrical space; first closing means is sealingly engaged within one of the passageways, and second closing means is sealingly engaged within the other end thereof. The first closing means includes a sealing piston, and is adjustable to vary the position of the piston along the length of the "one" passageway. The sleeve member is of smaller outside diameter than the bearers, to normally dispose its outer surface slightly below the surfaces thereof. Thus, the cylindrical space between the sleeve member and the body portion can be filled with a hydraulic fluid and pressurized by adjustment of the "first" closing means to distend the sleeve member, thereby bringing the outer surface of the sleeve member into positions flush with and slightly above the bearer surfaces, and through an infinite range of intermediate positions.

The core member may have a raised circumferential rib adjacent each of the opposite ends of its body portion, to which the corresponding ends of the sleeve member are welded. Each of the passageways in the core may comprise a relatively large section extending axially into the shaft portion, and a relatively small section extending radially therefrom, within the body portion, to the cylindrical space, the closing means being seated within the relatively large section.

Other objects of the invention are attained by the provision of a rotary die cutting assembly comprising, in combination with the above-described anvil roll, a die cutting roll. The latter will have a cylindrical body portion, shaft portions extending axially from the opposite ends of the body portion for journalling in the press, and annular bearers adjacent the opposite ends of the body portion, the latter portion having a raised die element on its surface. In addition to the specific features described above, the core member and sleeve member will generally and preferably be made of steel.

DETAILED DESCRIPTION OF THE ILLUSTRATED EMBODIMENT

Figure 1:
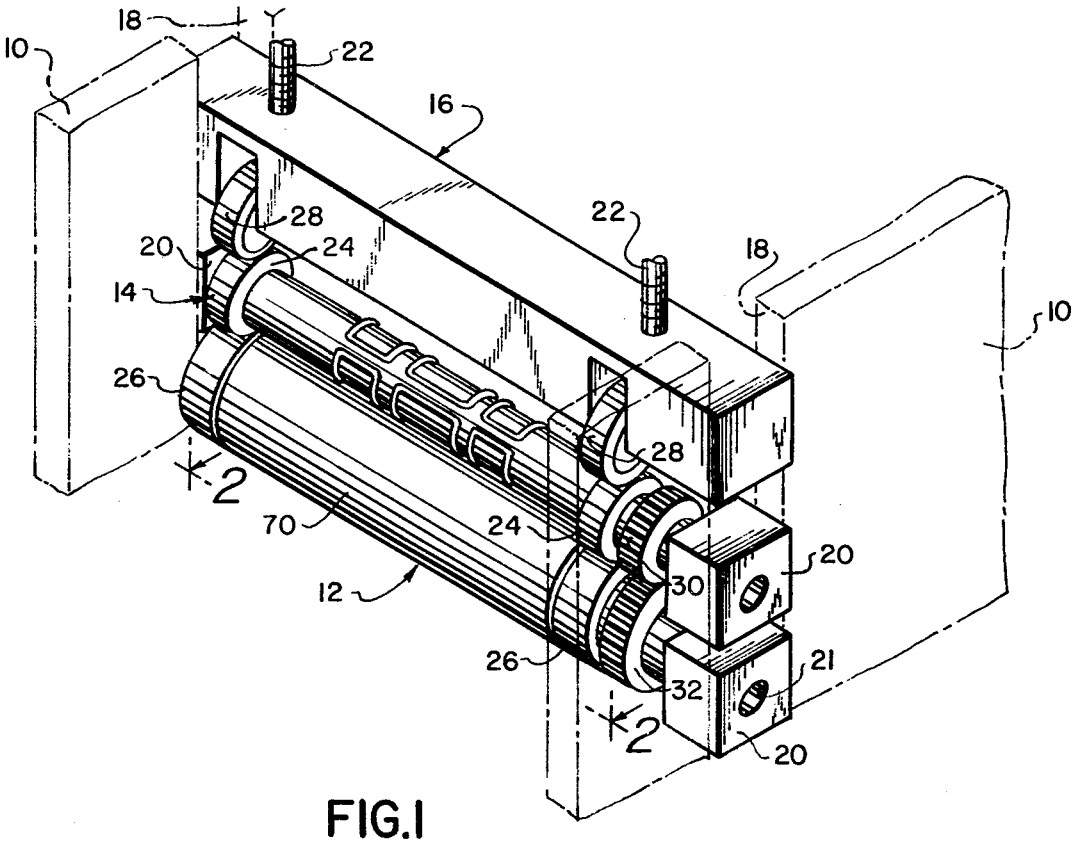
FIG. 1 is a fragmentary perspective view showing the adjustable anvil roll of the present invention mounted in a die cutting press, in assembly with a die cutting roll and an overlying assist block.

Turning now in detail to FIG. 1 of the appended drawings, therein illustrated is a die cutting roll assembly mounted in a press, side frame portions 10 of which are shown in phantom line. The roll assembly consists of an anvil roll, a die cutting roll, and an assist block, generally designated by the numerals 12, 14, and 16, respectively, which are stacked one upon the other within the vertical channel 18 provided in each of the side frame portions 10. The ends of the two rolls 12, 14 are journalled in appropriate bearing blocks 20, in accordance with standard practice, and two pressure screws 22 contact the upper surface of the bearing block to apply force from an overhead bridge (not shown).

Since it is the anvil roll 12 which constitutes the novel subject matter of the present invention, detailed description of the cutting roll 14 and the assist block 16 is considered to be unnecessary. Suffice to say that the die cutting roll 14 has end bearers 24 which are in direct surface and rolling contact with the end bearers 26 of the anvil roll 12, as well as with the rotatably mounted rollers 28 of the bearing block 16. The cutting roll 14 also has a gear 30 affixed to one end and in meshing engagement with the gear 32 on the end of the anvil roll 12. These gears are in operative engagement with a suitable drive gear, through which motive power for the die cutting system is provided.

Figure 2:
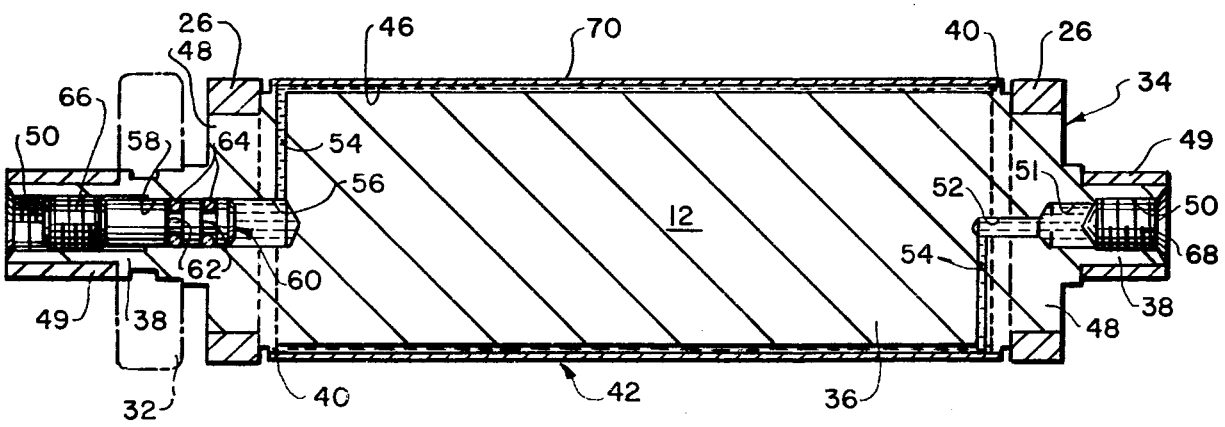
FIG. 2 is a sectional view of the anvil roll shown in FIG. 1, taken along line 2—2 thereof and drawn to an enlarged scale.

The details of construction of the anvil roll 12 are most fully shown in FIG. 2, and it can be seen to consist of a core member, generally designated by the numeral 34, having a central body portion 36 and shaft portions 38, 38' extending axially from the opposite ends of the body portion 36. A small circumferential rib 40 extends about the core 34 directly adjacent each end of the body portion 36, to which the opposite ends of the tubular shell, generally designated by the numeral 42, are secured, such as by welding to produce a leak-proof connection. Because the inside diameter of the shell 42 is slightly larger than the outside diameter of the center body portion 36 of the core member 34, a shallow cylindrical space 46 is defined between the surfaces of the shell and the core.

Adjacent each end of the central portion 36 of the core member is formed a reduced-diameter shoulder 48, on which an annular bearer 26 is affixed. The shaft portions 38, 38' are both configured to mount the inner race 49 of a needle bearing, by which the roll is mounted in the bearing blocks 20; the shaft portion 38 is somewhat longer than the shaft portion 38', so as to accommodate the gear 32, which is affixed thereon and is shown (in this figure) in phantom line.

The shaft portion 38' has an axially extending bore formed therein, which has a threaded outer section 50, an intermediate section and an inner section 52, which communicates with a radial passageway 54; the latter extends to the cylindrical space 46, and provides liquid flow communication therewith. Similar construction is provided in the shaft portion 38 at the opposite end of the anvil roll 12, with the exception that the inner section 56 of the bore is of larger diameter than the section 52 of the bore at the opposite end, and that the cylindrical section 58 is somewhat longer than the sections 51.

A piston, generally designated by the numeral 60, is slideably received in the intermediate section 58 of the bore in the shaft 38, and it has a pair of circular grooves 62 adjacent its inner end, in each of which is seated a sealing O-ring 64. Outwardly of the piston 60 is provided an adjusting set-screw 66, which is threadably engaged in the outer section 50 of the bore, and a sealing plug 68 is threadedly engaged in the corresponding section of the opposite shaft portion 38'. The location of the bores in the shaft portions, as shown, will generally be preferred, particularly when access to the set-screw 66 is to be had through the corresponding bearing block 20, without dismounting the roll form the press. In some instances, however this would preclude access, due to the manner of mounting or interference from other parts. In those cases the bores can extend, for example, from points on the end surfaces of the body portion itself.

To prepare the roll 12 for operation in the die cutting press, it is initially filled with hydraulic fluid, to occupy the space within the axial bore sections, the radial passages 54, and the cylindrical space 46. Following replacement of the plug 68, the piston 60, and the adjusting screw 66, the pressure within the internal hydraulic system can be adjusted by appropriate positioning of the screw 66, and thereby of the piston 60. As shown in FIGS. 1 and 2, the piston 60 is in an intermediate position, causing the shell 42 to be distended somewhat from its most retracted condition, and bringing its outer surface 70 into flush alignment with the surfaces of the end bearers 26.

Figure 3:
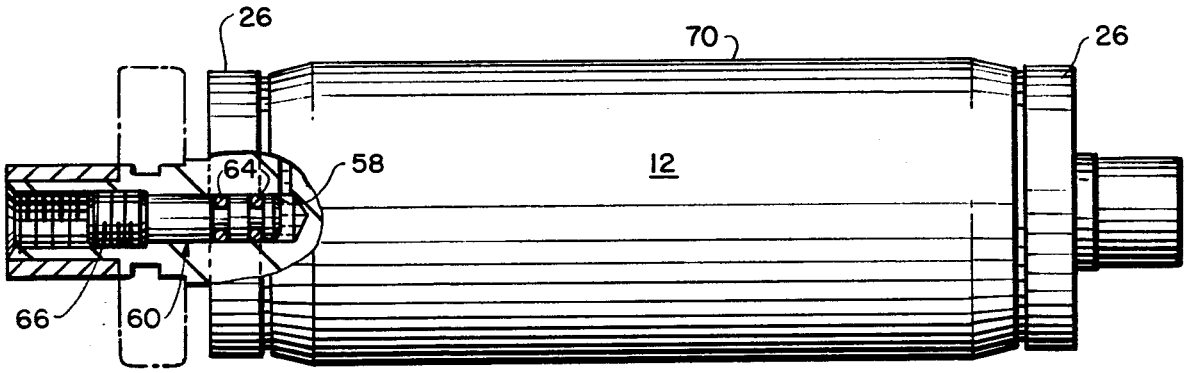
FIG. 3 is a rear elevational view of the anvil roll, in partial section and showing the shell in its most fully expanded condition.
Figure 4:
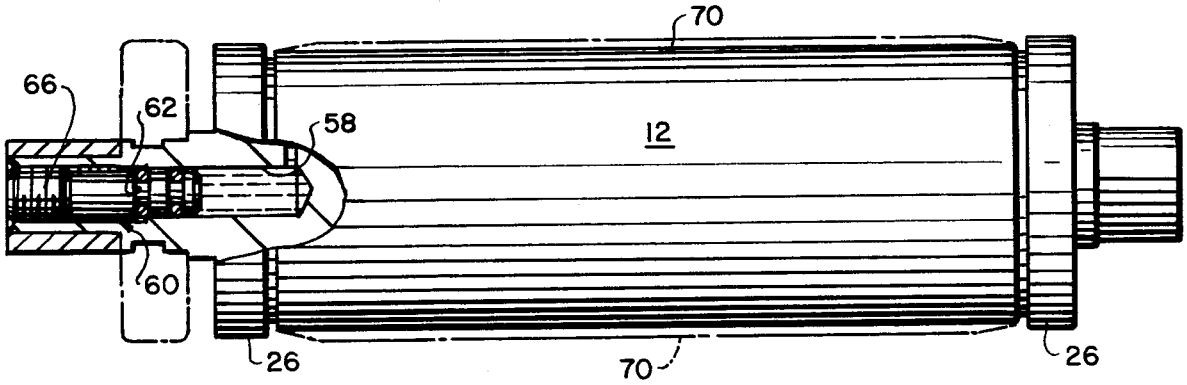
FIG. 4 is a view similar to FIG. 3, showing the shell in its most retracted condition, and depicting the flush position of FIGS. 1 and 2 in phantom line.

Alternate positions of the shell 42 are shown in FIGS. 3 and 4. In the first Figure, the screw 66 has been adjusted to its extreme inward position, causing the piston 60 to generate the maximum amount of pressure in the space 46 (not visible). This will cause the shell to distend to its maximum extent; as can be seen, the surface 70 is slightly above the surfaces of the reference bearers 26. In FIG. 4, the adjusting screw 66 has been withdrawn to its outermost position, reducing the level of pressure within the inner space, and permitting the shell 42 to assume its most inward position, with the outer surface 70 below the surface of the bearers.

In the condition depicted in FIG. 3, the spacing of the base roll from the cutting edges of the roll 14 would be at a minimum, since the surface 70 of the shell is above that of the bearers. In FIG. 4, on the other hand, a maximum amount of spacing would exist between the base surface of the shell and the cutting elements of the die 14. The intermediate position of the surface of the shell, corresponding to the condition illustrated in FIGS. 1 and 2, is shown in phantom line.

Figure 5:
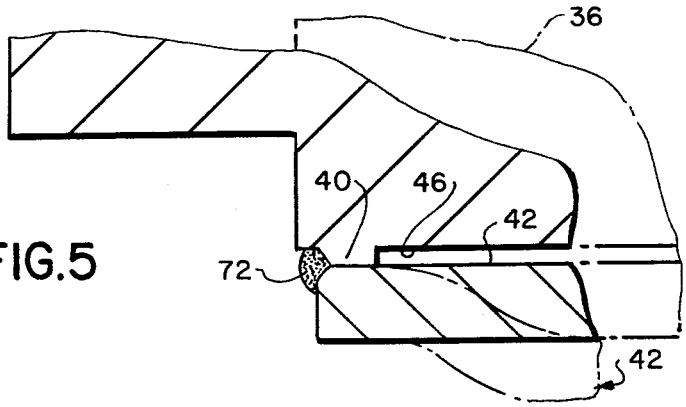
FIG. 5 is a fragmentary view, in partial section and greatly enlarged, showing the structure of the anvil roll at the joint between the core and sleeve members, and showing in full and phantom line, respectively, the retracted and distended positions of the shell.

Turning finally to FIG. 5 of the drawings, the details of a construction by which the shell 42 can be affixed to the core 34 is illustrated. As shown therein, a ring-shaped weldment 72 is made at the seam between the ends of the shell 42 and the ribs 40 on the body 36, so as to create the necessary seal without unduly inhibiting flexibility of the shell 42. Its ability to flex is diagrammatically illustrated, the distended and retracted conditions being shown in phantom and full line, respectively. While steel construction will normally be used for both the core and the shell members, the gauge of the latter must, of course, be sufficiently thin to permit adequate flexibility, consistent with the provision of a durable and secure base against which the die cutting roll can work.

It should be appreciated that the magnitude of the deflection of the shell is exaggerated in the drawings for purposes of illustration. Normally, the change will be much less extreme, relative to the size of the roll; in a typical case, a variation of plus of minus one mil from the flush position will suffice to accommodate the intended purpose. The construction illustrated is specifically designed to permit such variation as is peculiar to die cutting operations.

Thus, it can be seen that the present invention provides a novel anvil roll in which the height of the cylindrical body portion, which provides the base surface against which the die element operates, can be varied in relationship to the circumference of the end barriers. More specifically, the invention provides such a variable diameter anvil roll having a self-contained hydraulic system, in which the relationship between the bearers and the cutting base surfaces, and hence of the cutting edge relative thereto, can be adjusted without dismounting the roll from the press. The roll is of relatively simple and inexpensive construction, and requires virtually no added effort for installation and use. A novel rotary die cutting assembly, for mounting in a press, is also provided.

Having thus described the invention, what is claimed is:

1. A variable diameter anvil roll, having a self-contained hydraulic system, for cooperation with an adjacently mounted die cutting roll, comprising: a core member having a cylindrical body portion and shaft portions extending axially from the opposite ends thereof for journalling in the press; annular bearers adjacent said opposite ends of said body portion; a resiliently deformable tubular sleeve member affixed upon said body portion between said bearers, said sleeve member having an inside diameter slightly larger than the outside diameter of said body portion and being sealed thereto adjacent its opposite ends to define a shallow cylindrical space therebetween, said core member having a passageway extending thereinto from each end into communication with said cylindrical space; first closing means sealingly engaged within one of said passageways, and second closing means sealingly engaged within the other of said passageways, said first closing means including a sealing piston and being adjustable to vary the position of said piston along the length of said one passageway, the outside diameter of said sleeve member normally being smaller than that of said bearers to dispose its outer surface slightly below the surfaces thereof, whereby said cylindrical space between said sleeve member and said body portion can be filled with a hydraulic fluid and pressurized, by adjustment of said first closing means, to distend said sleeve member, said outer surface of said sleeve member thereby being brought to positions flush with and slightly above said bearer surfaces, and through an infinite range of positions therebetween.

2. The roll of claim 1 wherein said core member has a raised circumferential rib adjacent each of said opposite ends of said body portion, to which said opposite ends of said sleeve member are welded.

3. The roll of claim 1 wherein each of said passageways comprises a relatively large section extending axially into each of said shaft portions, and a relatively small section extending radially therefrom within said body portion to said cylindrical space, said closing means being seated within said relatively large section of the associated passageway.

4. A rotary die-cutting assembly for mounting in a press, comprising:

(a) a die-cutting roll having a cylindrical body portion, shaft portions extending axially from the opposite ends of said body portion for journalling in the press, and annular bearers adjacent said opposite ends of said body portion, said body portion having a raised die element on the surface thereof; and (b) a variable diameter anvil roll, having a self-contained hydraulic system, including a core member having a cylindrical body portion and shaft portions extending axially from the opposite ends thereof for journalling in the press; annular bearers adjacent said opposite ends of said body portion and spaced from one another a distance substantially the same as the spacing between said bearers of said die cutting roll; a resiliently deformable tubular sleeve member affixed upon said body portion between said bearers, said sleeve member having an inside diameter slightly larger than the outside diameter of said body portion and being sealed thereto adjacent its opposite ends, to define a shallow cylindrical space therebetween, said core member having a passageway extending thereinto from each end into communication with said cylindrical space; first closing means sealingly engaged within one of said passageways; and second closing means sealingly engaged within the other of said passageways, said first closing means being adjustable to vary its position along the length of said one passageway, the outside diameter of said sleeve member normally being smaller than that of said bearers to dispose its outer surface slightly below the surfaces thereof; whereby said cylindrical space between said sleeve member and said body portion of said anvil roll can be filled with a hydraulic fluid, and pressurized by adjustment of said first closing means, to distend said sleeve member, said outer surface of said sleeve member thereby being brought to positions flush with and slightly above said bearer surfaces, to thereby alter the clearance between said surface and said die element of said die cutting roll when said die cutting roll and said anvil roll are adjacently mounted in the press with their respective bearers in rolling contact with one another.

5. The assembly of claim 4 wherein said first closing means includes a sealing piston slidably seated in said one passageway.

6. The roll of claim 5 wherein each of said passageways comprises a relatively large section extending axially into eacch of said shaft portions, and a relatively small section extending radially therefrom within said body portion to said cylindrical space, said closing means being seated within said relatively large section of the associated passageway.

7. The roll of claim 4 wherein said core member and sleeve member are made of steel, and wherein said core member has a raised circumferential rib adjacent each of said opposite ends of said body portion to which said opposite ends of said sleeve member are welded.

* * * * *